US012286730B2

(12) United States Patent
Yamagishi

(10) Patent No.: US 12,286,730 B2
(45) Date of Patent: Apr. 29, 2025

(54) INTERMEDIATE RECEIVING MECHANISM FOR WARP BEAM IN LOOM

(71) Applicant: TSUDAKOMA KOGYO KABUSHIKI KAISHA, Ishikawa-ken (JP)

(72) Inventor: Daigo Yamagishi, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 0 days.

(21) Appl. No.: 18/382,744

(22) Filed: Oct. 23, 2023

(65) Prior Publication Data

US 2024/0167202 A1 May 23, 2024

(30) Foreign Application Priority Data

Nov. 22, 2022 (JP) ..... 2022-186093

(51) Int. Cl.
*D02H 13/38* (2006.01)
*D03D 49/00* (2006.01)
*D03D 49/02* (2006.01)

(52) U.S. Cl.
CPC ..... *D02H 13/38* (2013.01); *D03D 49/00* (2013.01)

(58) Field of Classification Search
CPC ..... D02H 13/38; D02H 13/28; D03D 49/00; D03D 49/025; D03D 49/06; D03D 49/12
See application file for complete search history.

(56) References Cited

U.S. PATENT DOCUMENTS 983,550 A * 2/1911 Harrington ..... D03D 47/24 139/438
2,522,629 A * 9/1950 Mastriani ..... D03D 51/28 139/357
2,561,416 A * 7/1951 Worth ..... D03D 47/44 139/432

(Continued)

FOREIGN PATENT DOCUMENTS

CH 273915 A 3/1951
EP 2350364 B1 4/2014
JP 2021-172901 A 11/2021

OTHER PUBLICATIONS

Apr. 9, 2024, European Search Report issued for related EP Application No. 23205617.6.

*Primary Examiner* — Robert H Muromoto, Jr.
(74) *Attorney, Agent, or Firm* — Paratus Law Group, PLLC

(57) ABSTRACT

An intermediate receiving mechanism includes a base member capable of supporting both shaft end portions, a lever member for clamping both shaft end portions, and two beam support sets arranged side by side, corresponding to respective warp beams. Each beam support sets is constituted by two or more supporting rollers on the base member side and a contact part including one or more contact rollers on the lever member side. The lever member includes a swing member swings about a swing shaft and supports both the contact parts. Support positions on the swing member for both the contact parts are positions where a line segment connecting the support position for one contact part and a shaft center of the swing shaft forms an angle with respect to a line segment connecting the support position for the other contact part and the shaft center.

1 Claim, 5 Drawing Sheets

(56) References Cited

U.S. PATENT DOCUMENTS

| | | | | | |
|---|---|---|---|---|---|
| 2,582,761 | A * | 1/1952 | Shertz | D03D 49/24 | 139/145 |
| 2,791,242 | A * | 5/1957 | Cashion | D03D 49/70 | 139/303 |
| 2,889,855 | A * | 6/1959 | Turner | D03D 51/02 | 139/336 |
| 3,441,058 | A * | 4/1969 | Bassing | D03D 51/02 | 139/1 R |
| 3,459,237 | A * | 8/1969 | Xaus | D03C 1/144 | 139/89 |
| 4,387,741 | A * | 6/1983 | Palau | D03C 1/00 | 139/66 R |
| 4,850,399 | A * | 7/1989 | Linka | D03D 47/361 | 139/50 |
| 5,020,573 | A * | 6/1991 | Debaes | D03D 47/38 | 139/453 |
| 5,411,064 | A * | 5/1995 | Yamagishi | D03D 47/06 | 139/432 |
| 5,423,354 | A * | 6/1995 | Herrlein | D03D 39/226 | 139/26 |
| 11,591,724 | B2 * | 2/2023 | Myogi | D03D 51/02 | |
| 11,732,389 | B2 * | 8/2023 | Myogi | D03D 51/02 | 139/1 E |
| 11,753,753 | B2 * | 9/2023 | Myogi | D03D 51/02 | 139/1 E |
| 2009/0088035 | A1 * | 4/2009 | Gonzalez | B63H 16/12 | 440/105 |
| 2021/0332508 | A1 * | 10/2021 | Myogi | D03D 49/02 | |
| 2022/0195641 | A1 * | 6/2022 | Porte | D03C 3/20 | |

* cited by examiner

INTERMEDIATE RECEIVING MECHANISM FOR WARP BEAM IN LOOM

CROSS-REFERENCE TO RELATED APPLICATION(S)

This application is based on and claims priority under 35 USC 119 from Japanese Patent Application No. 2022-186093 filed on Nov. 22, 2022, the contents of which are incorporated herein by reference.

TECHNICAL FIELD

The present invention relates to an intermediate receiving mechanism for a warp beam in a loom that rotatably supports shaft end portions of both warp beams between adjacent flanges of the pair of warp beams arranged side by side in a weaving width direction.

BACKGROUND ART

For example, Patent Literature 1 discloses a support structure for rotatably supporting a warp beam in a loom. The support structure disclosed in Patent Literature 1 consists of a pair of beam support mechanisms each attached to each side frame of the loom. In addition, each beam support mechanism has a beam support having an arcuate supporting surface for receiving a shaft end portion of a warp beam, and a clamp lever for holding the warp beam (shaft end portion) received in the beam support.

The clamp lever is attached to the beam support so as to be rotatable between a clamp position where it holds the warp beam and an open position where it opens the warp beam. In addition, the clamp lever has a circular arc surface (supporting surface) in contact with the shaft end portion of the warp beam. The beam support mechanism is adapted to support the warp beam in the form of clamping the shaft end portion of the warp beam by the supporting surface of the beam support and the supporting surface of the clamp lever.

Note that, as a loom, there is a loom of a so-called twin-beam specification in which two (one pair) warp beams are arranged side by side in a weaving width direction and weaving is performed by warp threads pulled out from both the warp beams. In the loom of a twin-beam specification, the warp beams are supported at outer-side shaft end portions by the pair of beam support mechanisms as described above and are also supported at inner-side shaft end portions by an intermediate receiving mechanism provided between adjacent flanges. In addition, the intermediate receiving mechanism is configured to clamp the shaft end portion of the warp beam by a beam support and a clamp lever, similarly to the beam support mechanism described above.

However, in the loom of a twin-beam specification, it is necessary to arrange the two warp beams in a state in which they are as close as possible in the weaving width direction (a state in which a gap between the flanges is as small as possible). For this reason, a dimension, in the weaving width direction, of each inner-side shaft end portion of the two warp beams is extremely small, as compared with that of the outer-side shaft end portion. Further, in a loom of the related art, the intermediate receiving mechanism for supporting the inner-side shaft end portion is configured as a common (single) structure for the two warp beams, and is adapted to support together the shaft end portions of the two warp beams.

CITATION LIST

Patent Literature

Patent Literature 1: JP2021-172901A

All warp beams are basically manufactured so that outer diameters of the shaft end portions are the same or similar. However, actually, the outer diameters are not completely the same in all the warp beams. Therefore, in the common intermediate receiving mechanism as described above, the shaft end portions of the two warp beams are simultaneously clamped and supported by the supporting surface of the beam support and the supporting surface of the clamp lever, but due to the different outer diameters of both the shaft end portions, the shaft end portion with a smaller outer diameter is supported with a slight gap.

For this reason, due to vibration generated during operation of the loom, one warp beam (shaft end portion with the smaller outer diameter) vibrates in the intermediate receiving mechanism. Then, as a result of the shaft end portion rubbing against the supporting surfaces of the beam support and the clamp lever of the intermediate receiving mechanism due to the vibration, the shaft end portion or both the supporting surfaces may be worn. Further, there is a concern that when such wear occurs, the gap will become larger and the vibration of the warp beam will become larger, leading to breakage of the intermediate receiving mechanism.

SUMMARY

Therefore, the present invention relates to an intermediate receiving mechanism for supporting the inner-side shaft end portions of two warp beams in a loom of a twin-beam specification, and an object thereof is to provide a configuration capable of reliably supporting both shaft end portions without a gap, respectively.

In order to achieve the above object, the present invention has a preamble of the intermediate receiving mechanism in the loom of a tin-beam specification as described above, and is characterized in that the intermediate receiving mechanism includes a base member configured to be able to support both the shaft end portions, a lever member provided to be rotatable with respect to the base member, and configured to clamp both the shaft end portions in a state of being supported on the base member, in cooperation with the base member, and two beam support sets arranged side by side adjacent to each other in the weaving width direction, corresponding to the respective warp beams. Further, the present invention is characterized in that each of the beam support sets includes two or more supporting rollers provided for the base member and configured to support the shaft end portion, and a contact part including one or more contact rollers provided for the lever member and configured to be brought into contact with the shaft end portion; the lever member includes a swing member provided to be able to swing about a swing shaft provided in parallel to the weaving width direction, and configured to support both the contact parts, and support positions on the swing member for both the contact parts are positions where a line segment connecting the support position for one contact part and a shaft center of the swing shaft forms an angle with respect to a line segment connecting the support position for the other contact part and the shaft center.

The intermediate receiving mechanism of the present invention is configured to include two beam support sets arranged side by side adjacent to each other in the weaving width direction, corresponding to each warp beam, each of the beam support sets including two or more supporting rollers on the base member side and a contact part including one or more contact rollers on the lever member side. Further, each contact part on the lever member side is supported by the swing member provided to be able to swing about the swing shaft of the lever member so that the line segment connecting the support position for the contact part in one beam support set and the shaft center of the swing shaft forms an angle with respect to the line segment connecting the support position for the contact part in the other beam support set and the shaft center. Thereby, by rotating the lever member with respect to the shaft end portion of the warp beam supported by the two or more supporting rollers on the base member side, the contact roller of the corresponding contact part can be brought into contact reliably, and therefore, the shaft end portion can be reliably supported without a gap.

More specifically, when the lever member is rotated toward the shaft end portion of the warp beam supported by the two or more supporting rollers on the base member side, first the contact part (contact roller) of the lever member on one side of the two beam support sets comes into contact with a circumferential surface of the shaft end portion of the warp beam corresponding to the contact part. Then, when the lever member is further rotated from the state, since the one contact part is in contact with the warp beam (shaft end portion), the swing member supporting both the contact parts swings, and the contact part (contact roller) in the other beam support set comes into contact with a circumferential surface of the shaft end portion of the corresponding warp beam. As a result, both the beam support sets are brought into complete contact with the circumferential surfaces of the shaft end portions of the corresponding warp beams by the respective supporting rollers and the contact rollers of the contact parts. Further, by fixing the lever member to the base member, the shaft end portions of both the warp beams are clamped and supported without gaps by the base member and the lever member via the corresponding beam support sets.

In this way, according to the intermediate receiving mechanism of the present invention, the shaft end portions of both the warp beams can be reliably supported without gaps by the supporting rollers and contact rollers of the corresponding beam support sets. Thereby, unlike the devices of the related art, the vibration of the shaft end portion having a smaller outer diameter within the intermediate receiving mechanism due to a gap between the shaft end portion and the intermediate receiving mechanism occurs hardly, and wear of the shaft end portion or both supporting surfaces due to the vibration and occurrence of problems caused by the wear can be prevented as much as possible.

DESCRIPTION OF EMBODIMENTS

Figure 1:
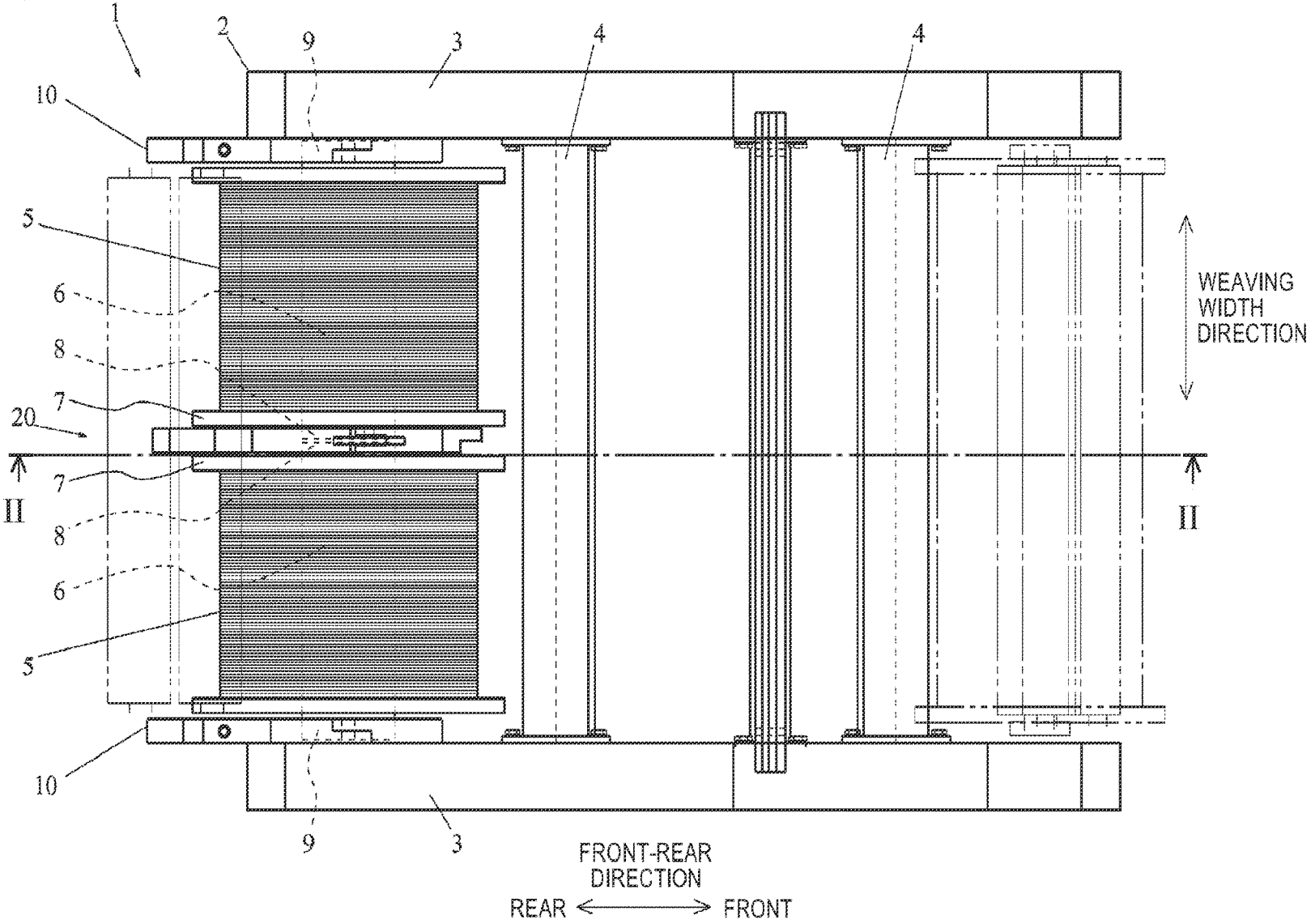
FIG. 1 is a plan view of a loom according to an embodiment of the present invention.
Figure 2:
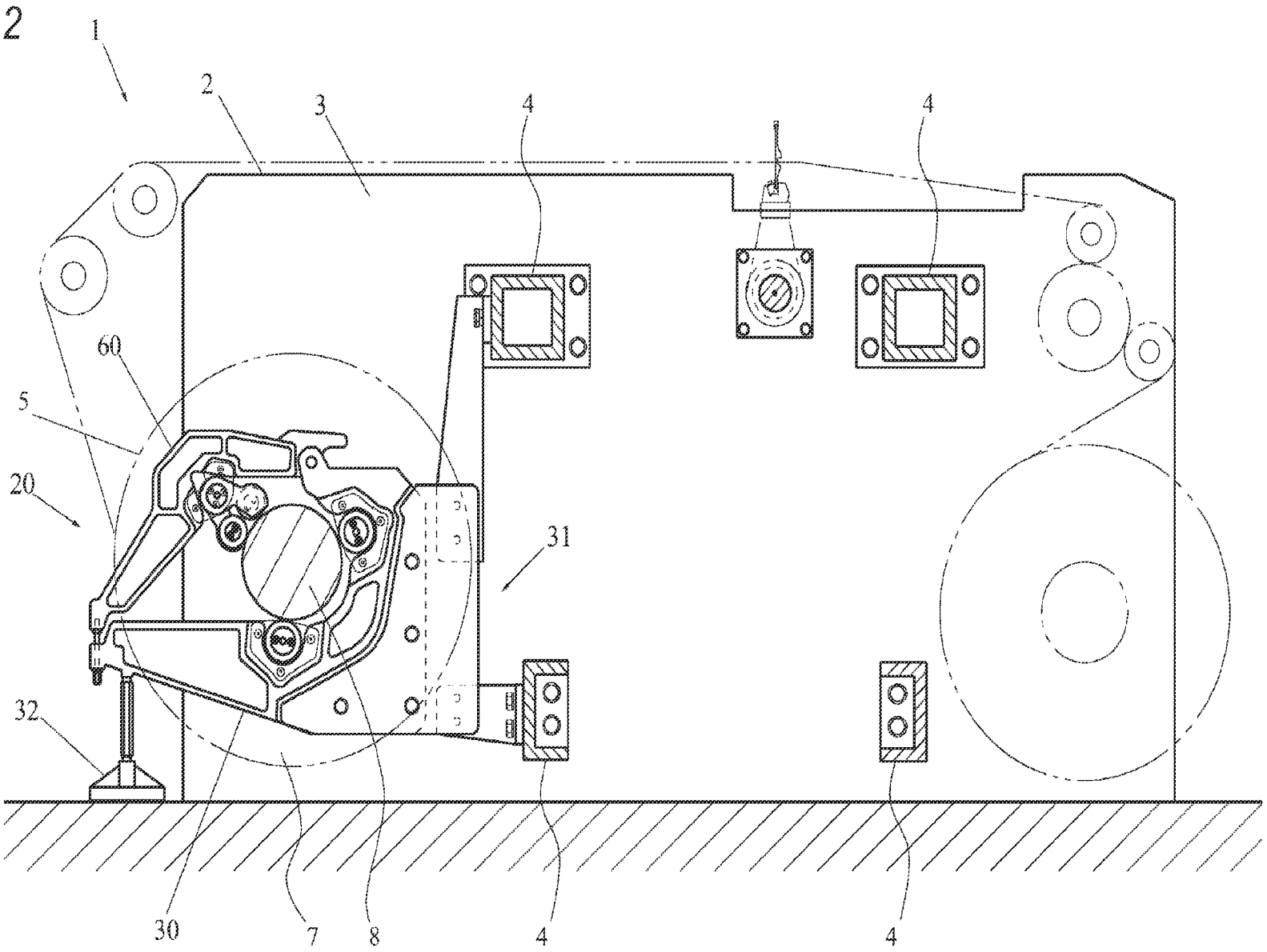
FIG. 2 is a cross-sectional view taken along an II-II line in FIG. 1.
Figure 3:
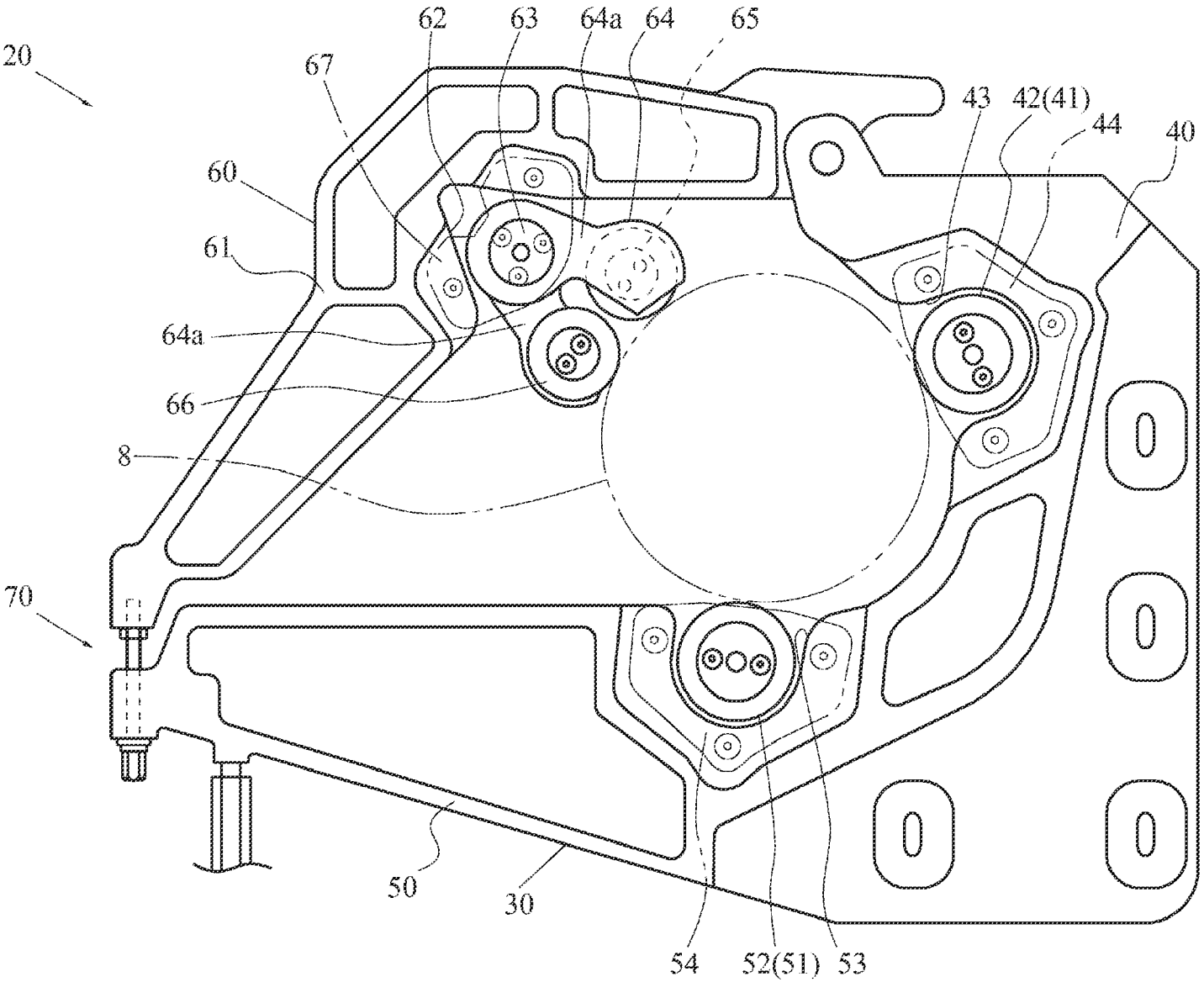
FIG. 3 is a side view of an intermediate receiving mechanism according to an embodiment of the present invention.
Figure 4:
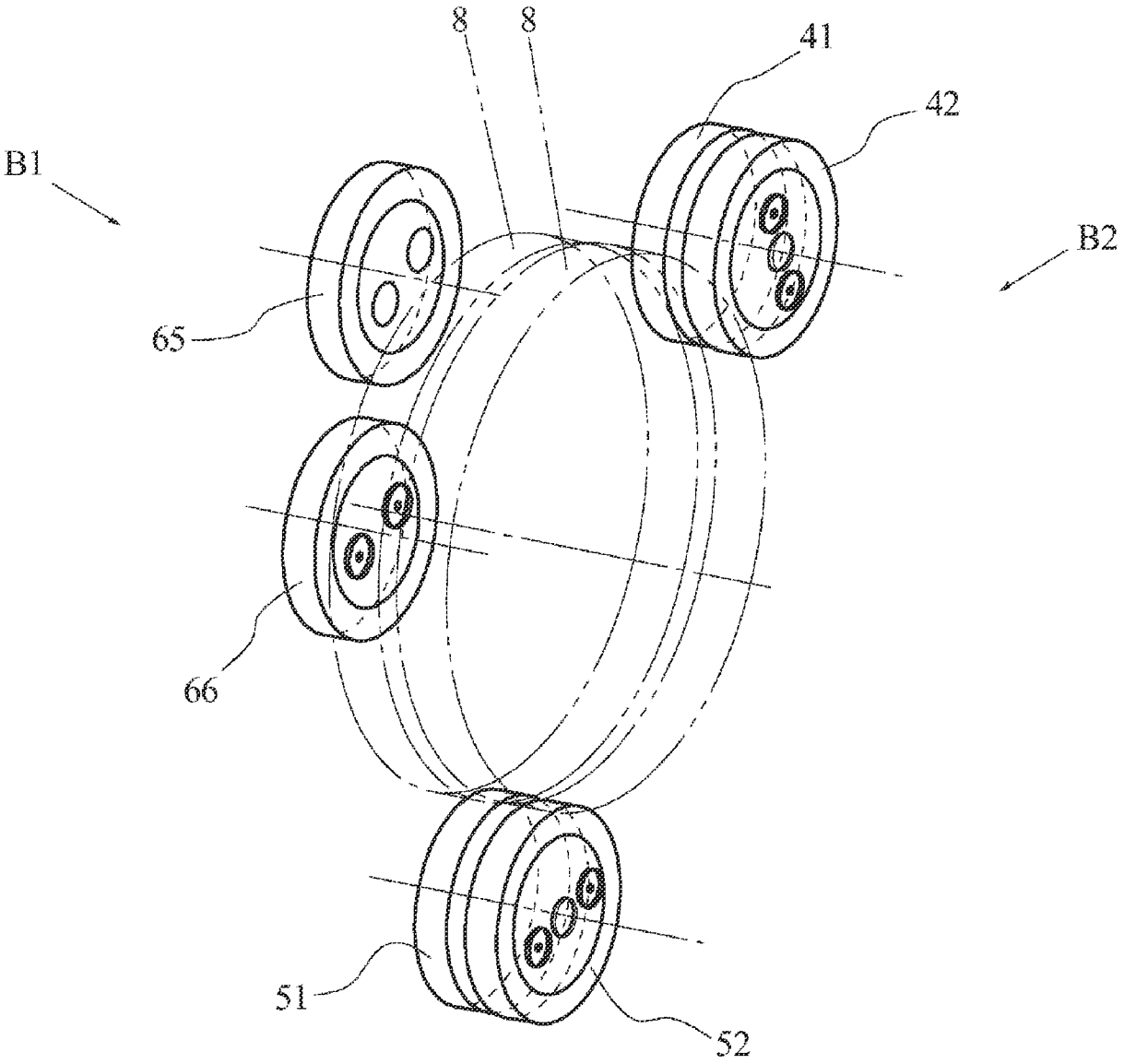
FIG. 4 is a perspective view of a beam support set according to an embodiment of the present invention.

Hereinafter, an embodiment of a loom to which the present invention is applied will be described with reference to FIGS. 1 to 4. Note that the loom to which the present invention is applied is a loom of a twin beam specification in which two (one pair of) warp beams are arranged side by side in a weaving width direction of the loom, as described above.

A loom 1 has, as a main body, a frame 2 formed by connecting a pair of side frames 3 and 3 with a plurality of (four) beam members 4. In addition, a pair of warp beams 5 and 5 are provided on the loom in the form of being supported with respect to the frame 2 in a state in which shaft centers thereof are made to substantially coincide with each other and the warp beams are arranged side by side in the weaving width direction. Note that each warp beam 5 includes a shaft-shaped winding part 6 on which a warp yarn is wound, a pair of disk-shaped flanges 7 and 7 located on both sides of the winding part 6, and shaft end portions 8 and 9 located outside the respective flanges 7. In the description below, regarding both the shaft end portions of each warp beam 5, in a state where both the warp beams 5 and 5 are arranged on the loom, the shaft end portion 8 located on an inner side is referred to as an inner-side shaft end portion, and the shaft end portion 9 located on an outer side is referred to as an outer-side shaft end portion.

As for the support of both the warp beams 5 and 5 on the loom, an outer-side support mechanism 10 for supporting the outer-side shaft end portion 9 of the warp beam 5 is provided for each side frame 3, in the form of being attached to an inner-side wall of the side frame. Note that since the outer-side support mechanism 10 itself is well-known in the technical field of looms, detailed description thereof is omitted, but the outer-side support mechanism includes a beam support fixed to the side frame 3 and a clamp lever provided for the beam support, and rotatably supports the outer-side shaft end portion 9 by receiving the outer-side shaft end portion 9 in a circular arc groove formed in the beam support and clamping the outer-side shaft end portion 9 with the beam support and the clamp lever via a bearing.

In addition, the inner-side shaft end portion 8 of the warp beam 5 is rotatably supported by an intermediate receiving mechanism 20 provided at a central part of the loom in the weaving width direction. As for the intermediate receiving mechanism, in the present invention, the intermediate receiving mechanism includes a base member capable of supporting the shaft end portions 8 and 8 of both the warp beams 5 and 5, a lever member that is provided to be rotatable with respect to the base member and clamps both the inner-side shaft end portions 8 and 8 in a state of being supported on the base member, in cooperation with the base member, and two beam support sets arranged side by side adjacent to each other in the weaving width direction, corresponding to the respective warp beams 5.

Each of the beam support sets includes two or more supporting rollers that are provided for the base member and support the shaft end portion, and a contact part including one or more contact rollers that are provided for the lever member and brought into contact with the shaft end portion. In addition, the lever member includes a swing member that is provided to be able to swing about a swing shaft provided in parallel to the weaving width direction and supports both the contact parts. Further, the lever member is configured so that support positions on the swing member for both the contact parts are positions where a line segment connecting the support position for one contact part and a shaft center of the swing shaft forms an angle with respect to a line segment connecting the support position for the other contact part and the shaft center.

Below, the intermediate receiving mechanism 20 of the present embodiment will be described in detail. In the intermediate receiving mechanism 20 of the present embodiment, each beam support set includes two supporting rollers provided on the base member side and a single contact roller provided on the lever member side, and the inner-side shaft end portion 8 of the corresponding warp beam 5 is supported at three points by the three rollers.

The intermediate receiving mechanism 20 has a base member 30 for receiving the inner-side shaft end portions 8 of both the warp beams 5 and 5, and a lever member 60 for maintaining a position of the inner-side shaft end portion 8 received on the base member 30.

The base member 30 is a plate-like member, and a dimension in a plate thickness direction is slightly larger than twice a protruding length of the inner-side shaft end portion 8 of the warp beam 5 from the flange 7. In addition, the base member 30 is formed to have a substantially L-shape when seen in the plate thickness direction.

More specifically, the base member 30 has a supporting part 40 for receiving the inner-side shaft end portion 8 and a guide part 50 extending from the supporting part 40 for guiding the warp beam 5 toward the supporting part 40, and the supporting part 40 and the guide part 50 are integrally combined. The supporting part 40 has a schematically rectangular shape when seen in the plate thickness direction. In addition, the guide part 50 has a substantially trapezoidal shape when seen in the plate thickness direction, and is formed to protrude from one side surface of both side surfaces of the supporting part 40 in a short side direction. However, as described above, the base member 30 forms an L-shape, and the size and combination of the guide part 50 with respect to the supporting part 40 form the L-shape.

Further, in the supporting part 40, a portion of the one side surface except the portion where the guide part 50 protrudes is formed such that it is mostly a circular arc surface. Further, the circular arc surface is formed such that a side surface of the guide part 50, which is a surface (guide surface) for guiding the warp beam 5, is continuous. Note that the circular arc surface is a portion for receiving the inner-side shaft end portion 8 of the warp beam 5.

Further, in the base member 30, the supporting part 40 is provided with a pair of supporting rollers 41 and 42 in the form of being arranged side by side in the plate thickness direction. More specifically, each of the supporting rollers 41 and 42 consists of an inner ring and an outer ring, and is configured such that the outer ring is rotatable with respect to the inner ring. In addition, the supporting part 40 is formed with an accommodating groove 43 opening to the circular arc surface. Note that the accommodating groove 43 is a groove forming a circular arc shape when seen in the plate thickness direction, and is sized to be able to accommodate the supporting rollers 41 and 42. In addition, the accommodating groove 43 is formed so that portions of the outer rings of the supporting rollers 41 and 42 slightly protrude from the circular arc surface in a state of accommodating both the supporting rollers 41 and 42.

Further, the pair of supporting rollers 41 and 42 are accommodated in the accommodating groove 43 in a state in which shaft centers thereof are matched with each other and aligned. Note that attachment (position fixing) of the supporting rollers 41 and 42 in a state of being accommodated in the accommodating groove 43 to the supporting part 40 is performed via a pair of brackets 44 and 44.

Specifically, a pair of plate-like brackets 44 and 44 are attached to the supporting part 40 in the form of covering the accommodating groove 43 on both sides of the accommodating groove 43 in the plate thickness direction. However, the brackets 44 and 44 are sized not to overlap, when seen in the plate thickness direction, the portions of the outer rings, which protrude from the circular arc surface, of the supporting rollers 41 and 42 accommodated in the accommodation groove 43. In addition, the inner ring of each of the supporting rollers 41 and 42 is formed with two through-holes penetrating in the plate thickness direction at positions eccentric from the shaft center of the inner ring. Further, both the brackets 44 and 44 are also formed with through-holes penetrating in the plate thickness direction at positions corresponding to the through-holes of the supporting rollers 41 and 42. By screw members inserted in the through-holes of both the brackets 44 and 44 and the supporting rollers 41 and 42, the inner rings of the supporting rollers 41, 42 are fixed to the brackets 44 and 44, and the supporting rollers 41 and 42 are supported by the supporting part 40 via the brackets 44 and 44.

In addition, the guide part 50 is also provided with a pair of supporting rollers 51 and 52, similarly to the pair of supporting rollers 41 and 42 in the supporting part 40 described above. Specifically, the pair of supporting rollers 51 and 52 are accommodated in an accommodating groove 53 formed in the guide part 50, and are supported by the guide part 50 via a pair of brackets 54 and 54. The accommodating groove 53 is formed to be opened to the guide surface at a position of the guide part 50 close to the supporting part 40. The pair of supporting rollers 51 and 52, in such a provided state, are in a state in which portions of their outer rings protrude from the guide surface when seen in the plate thickness direction.

In addition, the base member 30 is attached to the frame 2 with the circular arc surface of the guide part 50 facing rearward in a front-rear direction with a feed-out side of the loom 1 as a rear side while matching the plate thickness direction to the weaving width direction. Note that as for the attachment of the base member 30 to the frame 2, a bracket 31 is attached to the upper and lower beam members 4 and 4 on a rear side of the four beam members connecting the side frames 3 and 3. In addition, the base member 30 is fixed to the bracket 31 at the supporting part 40 by a screw member or the like, and thus, attached and supported to the frame 2 (beam members 4 and 4) via the bracket 31. In addition, the base member 30, in such a state attached to the frame 2, is also supported by a support stand 32 provided between a floor and a lower surface of the guide part 50 on a front end side of the guide part 50 (opposite side to the supporting part 40 side).

The lever member 60 is a member in which a main body portion 61 forms a lever shape. The main body portion 61 has a curved shape forming an obtuse angle at a substantially central portion when seen in the plate thickness direction. Further, a dimension of the lever member 60 in the plate thickness direction is substantially the same as that of the base member 30 in the plate thickness direction. In addition, the lever member 60 is connected to the supporting part 40 of the base member 30 on one end side in a state in which the plate thickness direction thereof is made to coincide with the plate thickness direction of the base member 30. Note that in the connected state, the plate thickness direction of the lever member 60 coincides with the plate thickness direction of the base member 30, and as described above, and the plate thickness direction of the base member 30 coincides with the weaving width direction. Therefore, in the following description, the direction is referred to as the (above) weaving width direction.

In addition, as for the connecting of the lever member 60 to the base member 30 (supporting part 40), at an upper end portion of the supporting part 40, a connecting pin is attached in such a way that its axis line is parallel to the weaving width direction. The lever member 60 is connected to the supporting part 40 via the connecting pin. Thereby, the lever member 60 is adapted to be able to rotate with respect to the supporting part 40 about the connecting pin.

Further, a bifurcated lever 64 as a swing member is attached to the main body portion 61 of the lever member 60, and contact rollers 65 and 66 as a contact part are attached to the bifurcated lever 64. More specifically, the main body portion 61 is formed at a substantially central portion thereof with a substantially inverted triangular concave portion 62 that opens toward the base member 30 side and opens in the weaving width direction. Further, plate-like brackets 67 and 67 are attached to the main body portion 61 in the form of covering most of the concave portion 62 on both sides of the concave portion 62 in the weaving width direction. In the concave portion 62, a swing shaft 63 is provided in the form of being installed to the brackets 67 and 67.

The bifurcated lever 64 is a member in which two plate-like arms 64*a* and 64*a* are overlapped at respective one ends in the plate thickness direction to form a V-shape and the two arms 64*a* and 64*a* are integrally formed. Therefore, the bifurcated lever 64 has a configuration in which both the arms 64*a* and 64*a* have an overlapping portion, when seen in the plate thickness direction, and positions of both the arms 64*a* and 64*a* are different in the plate thickness direction. Further, dimensions of both the arms 64*a* and 64*a* in the plate thickness direction are slightly smaller than a half of an interval between the brackets 67 and 67 attached to the main body portion 61, and therefore, a dimension of the overlapping portion in the plate thickness direction is slightly smaller than the interval between the brackets 67 and 67.

Further, the bifurcated lever 64 is supported to be able to swing with respect to the swing shaft 63 in such a form that the swing shaft 63 installed between the brackets 67 and 67 is inserted into a through-hole formed in the overlapping portion. Thereby, the bifurcated lever 64 is provided to be able to swing with respect to the main body portion 61 with the swing shaft 63 as a center. Further, in such a provided state, the position of the bifurcated lever 64 in the weaving width direction is regulated by the brackets 67 and 67 on both sides.

The contact rollers 65 and 66 are each attached to the other end of each arm 64*a* of the bifurcated lever 64. More specifically, each of the contact rollers 65 and 66 is composed of an inner ring and an outer ring, and is configured such that the outer ring is rotatable with respect to the inner ring. In addition, the inner ring of each of the contact roller 65 and 66 is formed at positions eccentric from a shaft center thereof with two through-holes penetrating in the plate thickness direction. Further, the other end of each arm 64*a* of the bifurcated lever 64 is also formed with through-holes penetrating in the plate thickness direction at the same interval as the through-holes of each of the contact rollers 65 and 66. The contact rollers 65 and 66 are attached to the other ends of the respective arms 64*a* of the bifurcated lever 64 by screw members inserted into the through-holes of each arm 64*a* of the bifurcated lever 64 and each of the contact rollers 65 and 66.

The attachment of the contact rollers 65 and 66 is performed on a side surface serving as the other arm 64*a* side of both side surfaces in the plate thickness direction of the corresponding one arm 64*a*. Therefore, in such an attached state, both the contact rollers 65 and 66 do not overlap each other in position with respect to the weaving width direction and are provided to be adjacent to each other when seen in the front-rear direction.

As a result of the contact rollers 65 and 66 being provided on the main body portion 61 via the bifurcated lever 64, the two contact rollers 65 and 66 adjacent in the weaving width direction, and the pair of supporting rollers 41 and 42 on the supporting part 40 and the pair of supporting rollers 51 and 52 on the guide part 50 side arranged side by side in the weaving width direction on the base member 30 side are substantially matched in position with respect to the weaving width direction.

That is, around a space defined by the base member 30 and the lever member 60 for accommodating the inner-side shaft end portion 8 of the warp beam 5 so as to support it, the contact roller 65 on one side and the support rollers 41 and 51 on one side form a set at substantially the same positions with respect to the weaving width direction, and the contact roller 66 on the other side and the supporting rollers 42 and 52 on the other side form a set at substantially the same positions. Then, each of the set of the contact roller 65 and the supporting rollers 41 and 51 and the set of the contact roller 66 and the supporting roller 42 and 52 becomes a beam support set for supporting the inner-side shaft end portion 8 of the corresponding warp beam 5. Note that, below, the beam support set composed of the contact roller 65 and the supporting rollers 41 and 51 is referred to as a first beam support set B1, and the beam support set composed of the contact roller 66 and the supporting rollers 42 and 52 is referred to as the second beam support set B2.

Further, since the bifurcated lever 64 is configured to form a substantially V-shape as described above, and the contact rollers 65 and 66 are each supported on the other end of each arm 64*a*, the support positions on the bifurcated lever 64 for the contact rollers 65 and 66 are positions where a line segment connecting a shaft center (support position) of one contact roller 65 and a shaft center of the swing shaft 63 forms an angle with respect to a line segment connecting a shaft center (support position) of the other contact roller 66 and the shaft center of the swing shaft 63 when seen in the weaving width direction.

The intermediate receiving mechanism 20 includes a holding mechanism 70 for holding the lever member 60 rotated to a position where the inner-side shaft end portion 8 of the warp beam 5 is clamped, at that position. Note that, in the present embodiment, the holding mechanism 70 is configured to hold the position of the lever member 60 by screwing a screw member inserted in a through-hole formed at a tip end of the guide part 50 of the base member 30 into a female screw hole formed at a tip end of the main body portion 61 of the lever member 60. In addition, the holding mechanism 70 is adapted to be able to adjust a force (clamping force) of clamping the warp beam 5 (inner-side shaft end portion 8) by the lever member 60 and the base member 30 by changing an amount of screwing of the screw member.

According to the intermediate receiving mechanism 20 of the present embodiment configured as described above, the inner-side shaft end portions 8 of both the warp beams 5 and 5 are supported as follows.

First, the inner-side shaft end portion 8 of one warp beam 5 of the two warp beams 5 and 5 arranged in the weaving width direction is placed on the supporting rollers 41 and 51 on the base member 30 side in the first beam support set B1, and the inner-side shaft end portion 8 of the other warp beam 5 is placed on the supporting rollers 42 and 52 in the second beam support set B2. In addition, the lever member 60 is rotated toward the base member 30. Thereby, one of the two contact rollers 65 and 66 supported by the bifurcated lever 64 of the lever member 60, for example, the contact roller 65 in the first beam support set B1 is brought into contact with a circumferential surface of the inner-side shaft end portion 8 of the corresponding warp beam 5. Then, when the lever member 60 is further rotated from that state, the contact roller 65 of the first beam support set B1 is in contact with the inner-side shaft end portion 8 of one warp beam 5, the bifurcated lever 64 swings and the contact roller 66 of the second beam support set B2 is brought into contact with a circumferential surface of the inner-side shaft end portion 8 of the other warp beam 5.

As a result, in the intermediate receiving mechanism 20, the supporting rollers 41 and 51 and contact roller 65 constituting the first beam support set B1, and the supporting rollers 42 and 52 and contact roller 66 constituting the second beam support set B2 are brought into complete contact at three points with the circumferential surfaces of the inner-side shaft end portions 8 of the corresponding warp beams 5, respectively. Further, by fixing the lever member 60 to the base member 30 with the holding mechanism 70 (by applying the clamping force to both the inner-side shaft end portions 8 and 8), the inner-side shaft end portions 8 of both the warp beams 5 and 5 are clamped and supported without gaps by the base member 30 and the lever member 60 via the corresponding beam support sets B1 and B2.

In this way, according to the intermediate receiving mechanism 20, the inner-side shaft end portions 8 of both the warp beams 5 and 5 can be reliably supported without gaps by the two beam support sets B1 and B2 constituted by the supporting rollers 41, 42, 51 and 52 and the contact rollers 65 and 66. Thereby, unlike the devices of the related art, the vibration of one shaft end portion (having a smaller outer diameter) within the intermediate receiving mechanism due to a gap between the shaft end portion and the intermediate receiving mechanism occurs hardly, and wear of the shaft end portion or the supporting surface of the intermediate receiving mechanism due to the vibration and occurrence of problems caused by the wear can be prevented as much as possible.

In the above, one embodiment (hereinafter, referred to as 'above embodiment') of the loom to which the present invention is applied has been described. However, the present invention is not limited to the configuration described in the above embodiment, and can also be implemented by other embodiments (modified embodiments) as described below.

(1) As for the contact part in the beam support set, in the above embodiment, the contact rollers 65 and 66 as a contact part are attached to the other ends of the respective arms 64*a* of the bifurcated lever 64 as a swing member. That is, in the above embodiment, the contact part in each of the beam support sets B1 and B2 is constituted by one contact roller. However, in the intermediate receiving mechanism of the present invention, the contact part may be configured to include two or more contact rollers.

Figure 5:
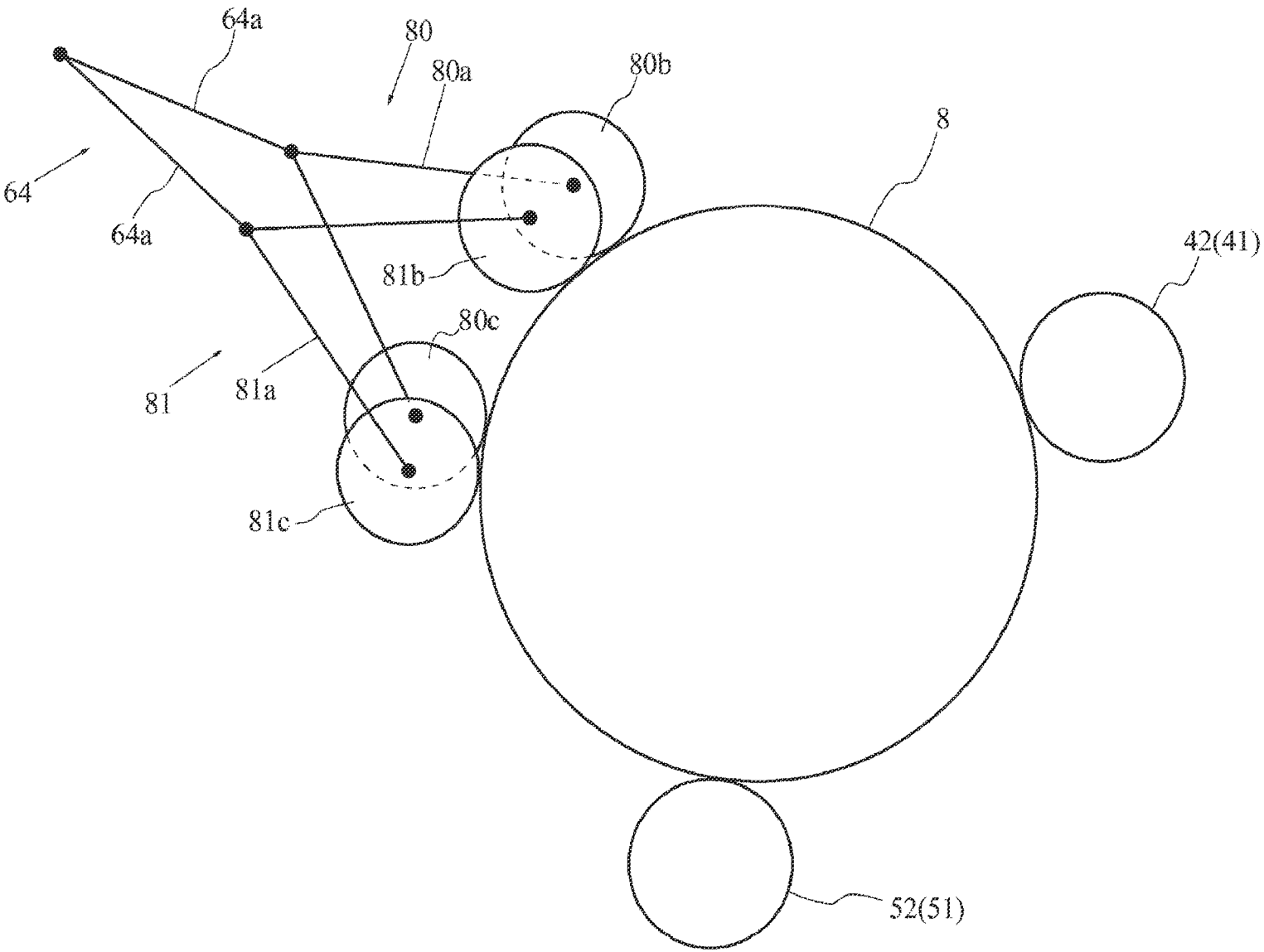
FIG. 5 is a simplified side view of an intermediate receiving mechanism according to another embodiment of the present invention.

For example, as shown in FIG. 5, the contact part may be configured to include two contact rollers. More specifically, a contact part 80, 81 is constituted by a support lever 80*a*. 81*a* formed in a V-shape, and contact rollers 80*b* and 80*c*, 81*b* and 81*c* attached to respective tip ends of the support lever 80*a*, 81*a*. Each of the contact parts 80 and 81 is swingably attached at the support lever 80*a*, 80*b* to the corresponding arm 64*a*. 64*a* of the bifurcated lever 64 supported by the lever member 60. Note that the attachment of the two contact rollers 80*b* and 80*c* (81*b* and 81*c*) to the support lever 80*a* (81*a*) is performed such that the two contact rollers 80*b* and 80*c* (81*b* and 81*c*) are substantially at the same positions with respect to the weaving width direction. Further, the attachment of the contact parts 80 and 81 (support levers 80*a* and 81*a*) to the bifurcated lever 64 is performed such that the two contact rollers 80*b* and 80*c* attached to one support lever 80*a* and the two contact rollers 81*b* and 81*c* attached to the other support lever 81*a* are provided adjacent to each other when seen in the front-rear direction.

In the intermediate receiving mechanism having the contact part configured as described above, similar to the above embodiment, when the lever member 60 is rotated in a state where the inner-side shaft end portions 8 of the two warp beams 5 and 5 are supported by the supporting rollers on the base member side, for example, one contact roller 80*b* of one contact part 80 and one contact roller 81*b* of the other contact part 81 are brought into contact with the circumferential surfaces of the inner-side shaft end portions 8 of the corresponding warp beams 5, respectively. Further, when the lever member 60 is further rotated from that state, the support levers 80*a* and 81*a* swing, and the remaining contact rollers 80*c* and 81*c* of the respective contact parts 80 and 81 are brought into contact with the circumferential surfaces of the inner-side shaft end portions 8 of the corresponding warp beams 5, respectively. Then, by applying a clamping force to both the inner-side shaft end portions 8 and 8 with the holding mechanism 70, the inner-side shaft end portions 8 of both the warp beams 5 and 5 are each brought into complete contact and supported at four points with the two contact rollers and the two support rollers in each beam support set.

(2) As for the supporting rollers in the beam support sets, in the above embodiment, the number of supporting rollers provided in each of the beam support sets B1 and B2 is two (supporting rollers 41 and 51 and supporting rollers 42 and 52). However, in the intermediate receiving mechanism of the present invention, each beam support set may be configured to have three or more supporting rollers. For example, when each beam support set is configured to have three supporting rollers, the intermediate receiving mechanism may be configured such that two supporting rollers aligned in the weaving width direction are provided between (middle) between the supporting rollers 41 and 42 provided on the supporting part 40 of the above embodiment and the supporting rollers 51 and 52 provided on the guide part 50 in the base member. However, the supporting rollers provided in the middle are naturally provided at positions where they can be brought into contact with the circumferential surface of the inner-side shaft end portion 8 in a state in which the inner-side shaft end portion 8 of the corresponding warp beam 5 is in contact with the supporting rollers on both sides.

Further, in the above embodiment, as for the supporting rollers 41, 42, 51 and 52 provided in the two beam support sets B1 and B2, the supporting rollers of one beam support set are rollers dedicated to the beam support set, and are also rollers formed as separate members from the supporting rollers of the other beam support set. However, in the present invention, the intermediate receiving mechanism may have a configuration in which a single (common) roller functions as a supporting roller for both the beam support sets. Specifically, for example in the configuration of the above embodiment, as the rollers provided in the accommodating groove 43(53), instead of the two supporting rollers 41 and

42 (supporting rollers 51 and 52), a single roller configured to be able to be brought into contact with the inner-side shaft end portions 8 of both the warp beams 5 and 5 may be used.

(3) As for the swing member, in the above embodiment, the bifurcated lever 64 in which the two plate-like arms 64*a* and 64*a* are overlapped to form a V shape and are integrally formed functions as the swing member. However, in the present invention, the swing member may be configured in such a way that two plate-like arms formed as separate bodies are overlapped to form a V-shape and then integrally combined with a screw member or the like.

Further, the swing member is a member that supports the contact part of each beam support set, and may be configured so that support positions on the swing member for both the contact parts are positions where a line segment connecting the support position for one contact part and a shaft center of the swing shaft forms an angle with respect to a line segment connecting the support position for the other contact part and the shaft swing shaft. Therefore, the swing member is not limited to being formed in a V-shape like the bifurcated lever 64 of the above embodiment, and may be configured by a triangular plate member, for example. However, in this case, the swing member is configured to be supported by the lever member via the swing shaft at a position near one of three vertices of the triangle, when seen in the plate thickness direction, and to support the corresponding contact part at each position near the two remaining vertices.

The present invention is not limited to the above embodiment, and can be variously changed without departing from the gist of the present invention.

The invention claimed is:

1. An intermediate receiving mechanism for warp beams in a loom configured to rotatably support shaft end portions of a pair of warp beams between adjacent flanges of the pair of warp beams arranged side by side in a weaving width direction, the intermediate receiving mechanism comprising:

a base member configured to be able to support both the shaft end portions;

a single lever member provided to be rotatable with respect to the base member, and configured to clamp both the shaft end portions in a state of being supported on the base member, in cooperation with the base member; and two beam support sets arranged side by side adjacent to each other in the weaving width direction, corresponding to the respective warp beams, wherein each of the beam support sets includes two or more supporting rollers provided for the base member and configured to support the shaft end portion, and a contact part including one or more contact rollers provided for the lever member and configured to be brought into contact with the shaft end portion, wherein the lever member includes a swing member provided to be able to swing about a swing shaft provided in parallel to the weaving width direction, and configured to support both the contact parts, and wherein support positions on the swing member for both the contact parts are positions where a line segment connecting the support position for one contact part and a shaft center of the swing shaft forms an angle with respect to a line segment connecting the support position for the other contact part and the shaft center.

* * * * *